United States Patent [19]

Verstraelen

[11] 4,221,589

[45] Sep. 9, 1980

[54] PROCESS FOR MELTING ALUMINUM OR ITS ALLOYS IN AN INDUCTION MELTING FURNACE

[76] Inventor: Ferdinand H. J. Verstraelen, Constitutiestraat 16, B-2000 Antwerpen, Belgium

[21] Appl. No.: 33,594

[22] Filed: Apr. 26, 1979

[30] Foreign Application Priority Data

Apr. 27, 1978 [DE] Fed. Rep. of Germany ..... 2818495

[51] Int. Cl.[2] ..... C22B 4/02

[52] U.S. Cl. ..... 75/10 R; 75/68 R

[58] Field of Search ..... 75/10 R, 68 R, 65 R

[56] References Cited

U.S. PATENT DOCUMENTS 3,443,806 5/1969 Galey et al. ..... 75/10 R

*Primary Examiner*—R. Dean

*Attorney, Agent, or Firm*—Allison C. Collard; Thomas M. Galgano

[57] ABSTRACT

In a process for melting aluminum or its alloys in an induction melting furnace of the channel type, in which the melting channels are to be protected by cryolithe against the attack of the melt, and wherein a gas or gas mixture is introduced into the melting channels of the inductor units, which gas contains halogens or compounds capable of splitting off halogens, the improvement that, for the production of the necessary quantity of cryolithe the melting charge contains an amount of sodium of at least 15 ppm together with an amount of lithium and/or calcium and/or potassium totalling at least 15 ppm. Substances are also introduced capable of splitting-off fluorine.

5 Claims, No Drawings

PROCESS FOR MELTING ALUMINUM OR ITS ALLOYS IN AN INDUCTION MELTING FURNACE

The present invention relates to a process for melting aluminum or its alloys in an induction melting furnace of the channel type, in which the melting channels are to be protected by cryolithe against the attack of the melt. In this type of furnace, a gas or gas mixture is introduced into the melting channels of the inductor units, which gas contains halogens or compounds capable of splitting off halogens which are removed from the melt together with impurities formed during the reaction.

In processes of this kind, it is customary to add to the melt slag-forming salts which are supposed to prevent the deposition of aluminum oxide adhering persistently to the melting channels. These slag-forming salts consist mainly of cryolithe ($Na_3AlF_6$) and they also contain melting point-reducing fluxes, especially calcium fluoride ($CaF_2$), sodium fluoride (NaF), aluminum fluoride ($AlF_3$) and magnesium fluoride ($MgF_2$).

It is further known from the state of the art to impregnate the refractory lining of the melting channels of the induction melting furnace with a salt mixture which contains 80% by weight of NaCl and 20% by weight of cryolithe ($Na_3AlF_6$). This impregnation prevents, for a time, the aluminum of the melt from reducing components of the refractory lining, such as quartz ($SiO_2$), iron oxide ($Fe_2O_3$) or titanium oxide ($TiO_2$) which causes the refractory lining to swell and become destroyed.

The addition of slag-forming salts containing mainly cryolithe and the mentioned use of cryolithe-containing-salt impregnation have the disadvantage that sodium will enter the melt. The following equation illustrates the fact:

$$Na_3AlF_6 + Al \rightleftarrows 2\ AlF_3 + 3\ Na \qquad (1)$$

The reaction (1) proceeds according to the mass action law mainly from left to right, when cryolithe is added to the melt. The sodium formed has to be eliminated by a suitable refining process, because too high a sodium content impairs the capability of the cast or extruded product from being rolled.

According to German Offenlegungsschrift No. 1 758 378 it is known, for that purpose, to blow gaseous chlorine or an inert gas mixed with chlorine though porous stoppers into the melting channels of the inductor units. However, difficulties arise when chlorine is blown into the channels because of the high corrosiveness of that gas. Due to the steadily-stricter regulations against enviromental pollution, expensive gas washing devices for the location where the work takes place combined with expensive alarm systems are considered an absolute necessity. Finally, the use of gaseous chlorine is also expensive, because the gas is so corrosive that the entire plant becomes endangered. This applies, on the one hand, to the furnace equipment proper and, on the other hand, to the casting machinery and other plant accessories.

In connection with the refining of an aluminum melt, it is known from German Auslegeschrift No. 25 44 854 to introduce into the melt e.g. chloro-fluoro-carbon for the purpose of eliminating sodium and other alkali metal impurities. This leads to the formation, among others, of cryolithe, from the fluorine split-off from the chloro-fluoro-carbon with the aluminum of the melt and sodium impurities otherwise contained in the melt. It is the purpose of the refining process to obtain aluminum as pure as possible. If the aluminum, purified as indicated, is used as charge in the channel induction furnace, and if, with the intention of preventing deposits in the melting channels and for the protection of the refractory lining of the channels, the above mentioned cryolithe-containing slag-forming salts and salt impregnations are used, the sodium entering into the melt makes the success of the refining process at least partly illusory, so that the melt has to be once more purified before casting.

It is the object of the present invention to provide a process for melting aluminum or its alloys in an induction melting furnace of the channel type, in which the melting channels are to be protected by cryolithe, against the attack of the melt, wherein the formation of deposits persistently adhering to the lining of the channels of the inductor units and the corrosion of the melt at the lining material is prevented, without sodium entering the melt which would then have to be separately eliminated.

This object is accomplished, according to the invention, by preparing the cryolithe-containing salt mixtures in the melt, instead of adding them thereto, with the provision that for the formation of the cryolithe in the melt the charge contains at least 15 ppm of sodium, and at least 15 ppm of lithium and/or calcium and/or potassium, and furthermore that compounds splitting off fluorine are introduced. While the cryolithe-containing salt mixtures are formed, the content of alkali metal impurities does not increase, but decreases, so that at the end of the melting process no after-purification of the melt becomes necessary, as was the case in the processes used heretofore.

The teaching of the invention shifts, as it were, the final operation of the refining process into the melting aggregate (melting induction furnace) and thereby prevents the melting channels of the inductor units from becoming encrusted and the refractory lining from being corroded. Furthermore, it becomes feasable to increase considerably the electrical output of the inductor units due to the fact that there are no deposits formed in the melting channels.

The process according to the invention combines the fluorine split-off from the compounds containing the same as shown in the following equations (2) to (7):

$$2\ Na + F_2 \rightarrow 2\ NaF \qquad (2)$$

$$2\ Li + F_2 \rightarrow 2\ LiF \qquad (3)$$

$$2\ K + F_2 \rightarrow 2\ KF \qquad (4)$$

$$Ca + F_2 \rightarrow Ca\ F_2 \qquad (5)$$

$$Mg + F_2 \rightarrow Mg\ F_2 \qquad (6)$$

$$2\ Al + 3\ F_2 \rightarrow 2\ AlF_3 \qquad (7)$$

with the metals present in the melting charge, primarily aluminum fluoride and magnesium fluoride, as well as the fluorides, acting as fluxes, of sodium, lithium, potassium and calcium. Due to the supply of aluminum fluoride of equation (7) and the sodium present in the melting charge, the reaction (1) proceeds according to the law of mass action from right to left, that is to say cryolithe is formed from the aluminum fluoride and the sodium. Furthermore, from the sodium fluoride formed according to equation (2) and the aluminum fluoride of equation (7) cryolithe will likewise be formed according to equation (8).

$$3\ NaF + AlF_3 \rightarrow Na_3Al\ F_6 \quad (8)$$

Finally, from the lithium fluoride according to (3) and the aluminum fluoride according to (7) plus the sodium contained in the melting charge, a cryolithe-like compound $LiNa_2AlF_6$is formed which has a melting point-reducing action on cryolithe.

As fluorine-splitting compounds, fluorocarbon and chlorofluorocarbon are particularly suitable. When there is too much cryolithe formed, it is advisable to introduce a compound, which splits off chlorine in addition to fluorine; thus e.g. chlorofluorocarbon. The added chlorine which is set free forms the following chlorides with the metals of the charge:

$$2\ Na + Cl_2 \rightarrow 2\ NaCl \quad (9)$$

$$2\ Li + Cl_2 \rightarrow LiCl \quad (10)$$

$$2\ K + Cl_2 \rightarrow 2\ KCl \quad (11)$$

$$Ca + Cl_2 \rightarrow CaCl_2 \quad (12)$$

$$Mg + Cl_2 \rightarrow MgCl_2 \quad (13)$$

$$2\ Al + 3\ Cl_2 \rightarrow 2\ AlCl_3 \quad (14)$$

This creates a further possibility of decreasing the contents of the melt in Na, Li, K and Ca to the desired degree and to thereby limit the amount of cryolithe formed.

The increased content of sodium, lithium, calcium and potassium in the melting charge can be obtained by buying a poorly refined batch for charging which has the particular advantage of being cheaply acquired. The increased contents may, however, be obtained by adding to the melting charge the elements in appropriate amounts. A preferred embodiment of the process according to the invention provides a content of 50–100 ppm sodium and 50–100 ppm lithium and/or calcium and/or potassium, each, in the charge. With these amounts of the metals indicated, sufficient quantities of cryolithe as well as lithium-, calcium-, and potassium fluoride will be formed.

As regards the gas mixture, an additional component, which splits-off chlorine, can be admixed, especially, chlorine-carbon. This substance for splitting-off chlorine is added when too much cryolithe or too many fluorides are formed. The substance splitting-off chlorine is preferably added toward the end of the process, when it can be estimated that by adding substances splitting-off fluorine alone, the necessary low final content of sodium, lithium, calcium and potassium cannot be obtained.

It is advantageous in the process of the invention to use a gas mixture consisting of an inert carrier gas, especially nitrogen or argon, to which the active substances are added in amounts depending on the requirements of the melt and/or the condition of the lining of the melting channels of the inductor units.

The invention will now be more fully described in an example, but it should be understood that this is given by way of illustration and not of limitation.

A channel-type melting furnace having a capacity of 50 t. and a charge weight of 30 t, is charged with goods containing besides aluminum, 75 ppm sodium, 75 ppm lithium, 75 ppm calcium and 75 ppm potassium. Each of the six inductor units of the furnace has an electric output of 600 KW. The melting channels of the inductor units are equipped with porous stoppers through which a gas mixture is continually blown into the individual channels during the melting operation. At the start, the gas mixture consists of nine parts argon and one part Freon 12 ($C\ Cl_2F_2$). The total quantity introduced amounts to 10 Nl per minute and inductor unit. The dross and slag formed is removed in appropriate intervals. The analysis of the melt is regularly checked. If the contents of sodium, lithium, potassium and calcium, particularly of sodium, drops too slowly, either the concentration of Freon 12 in the gas mixture is increased, or carbon tetrachloride ($CCl_4$) is added to the mixture. If, however, the contents of the mentioned substances drops too fast, the added amount of Freon 12 is decreased. Simultaneously, the quantity of cryolithe formed is checked. The quantity formed should just be adequate for the protection of the lining of the melting channels and for preventing the formation of aluminum oxide deposits. If too little cryolithe is formed, Freon 12 is partly or entirely replaced by Freon 14 ($CF_4$) to increase the supply of fluorine. If too much cryolithe is formed, the supply of chlorine is increased, e.g. by addition of carbon tetrachloride or by use of Freon 11 ($C\ Cl_3F$) instead of Freon 12. In general, the addition of flurocarbon and/or chloro-fluorocarbon and/or chlorocarbon is so adjusted that the analysis of the melt at the end of the melting process exhibits the required low values of sodium, lithium, calcium and potassium.

While only a single embodiment of the present invention has been shown and described, it will be obvious to those persons of ordinary skill in the art, that many changes and modifications may be made thereunto, without departing from the spirit and scope of the invention.

What is claimed is:

1. In a process for melting aluminum or aluminum alloys in an induction melting furnace of the channel type, in which the melting channels are to be protected by cryolithe against the attack of the melt and wherein a gas or gas mixture is introduced into the melting channels of the inductor units, said gas containing halogens or compounds capable of splitting off halogens, the improvement comprising forming the cryolithe in the melt by providing that the melting charge contains an amount of sodium of at least 15 ppm, and an amount of at least 15 ppm of a member selected from the group consisting of lithium, calcium, potassium and a mixture of at least two of these members, and wherein the gas introduced is fluorine.

2. The process according to claim 1, wherein the fluorine is introduced from a compound capable of splitting-off fluorine, said compound being selected from a group consisting of fluorocarbon, chloro-fluorocarbon, and a mixture thereof.

3. The process according to claim 1, wherein the contents of sodium in the charging melt is from 50 to 100 ppm, and a content of 50–100 ppm of a member of the group consisting of lithium, calcium, and potassium, and a mixture of at least two of these members.

4. The process according to claim 1, additionally including the step of introducing a substance capable of splitting-off chlorine.

5. The process according to claim 4, where the substance introduced is chlorocarbon.

* * * * *